US007259615B2

(12) United States Patent
Sasho et al.

(10) Patent No.: US 7,259,615 B2
(45) Date of Patent: Aug. 21, 2007

(54) BIAS VOLTAGE SUPPLY CIRCUIT AND RADIO-FREQUENCY AMPLIFICATION CIRCUIT

(75) Inventors: Noboru Sasho, Kanagawa (JP); Norio Shoji, Kanagawa (JP)

(73) Assignee: Sony Corporation (JP)

( * ) Notice: Subject to any disclaimer, the term of this patent is extended or adjusted under 35 U.S.C. 154(b) by 88 days.

(21) Appl. No.: 11/047,564

(22) Filed: Feb. 2, 2005

(65) Prior Publication Data

US 2005/0179484 A1 Aug. 18, 2005

(30) Foreign Application Priority Data

Feb. 16, 2004 (JP) ..... P2004-037969

(51) Int. Cl.
*H03F 3/189* (2006.01)
*H03L 5/00* (2006.01)
*G05F 1/575* (2006.01)

(52) U.S. Cl. ..... 327/545; 327/540; 330/296

(58) Field of Classification Search ..... None
See application file for complete search history.

(56) References Cited

U.S. PATENT DOCUMENTS 6,043,714 A * 3/2000 Yamamoto et al. ..... 330/296
6,331,799 B1 * 12/2001 Miyazawa ..... 327/538
6,359,516 B1 * 3/2002 Luo et al. ..... 330/296
6,414,553 B1 * 7/2002 Luo ..... 330/296
6,922,107 B1 * 7/2005 Green ..... 330/296
6,956,437 B2 * 10/2005 Lopez et al. ..... 330/296

FOREIGN PATENT DOCUMENTS

| | | |
|---|---|---|
| JP | 63-107306 | 5/1988 |
| JP | 09-054621 | 2/1997 |
| JP | 11-068473 | 3/1999 |
| JP | 2000-332124 | 11/2000 |

OTHER PUBLICATIONS

Japanese Office Action; Application No.: 2004-037969; Nov. 21, 2006.

* cited by examiner

*Primary Examiner*—Kenneth B. Wells
*Assistant Examiner*—Terry L. Englund
(74) *Attorney, Agent, or Firm*—Rader Fishman & Grauer PLLC; Ronald P. Kananen

(57) ABSTRACT

A bias-voltage supply circuit of a radio-frequency amplification circuit has the constant-voltage power supply generating a constant voltage higher than the bias voltage, a rectifier transistor and a constant-current power supply supplying a constant current to the rectifier transistor. The rectifier transistor is connected between a supply point of a bias voltage connected to an input terminal of the radio-frequency amplification transistor via an element for bias supply and a power supply voltage supply line, wherein a control terminal is kept by the constant voltage that the constant-voltage power supply generates. Since descent of the electric potential of the input terminal of a radio-frequency signal does not arise because of circuit composition, the radio-frequency amplification circuit has a good saturation characteristic.

13 Claims, 7 Drawing Sheets

1C

BIAS VOLTAGE SUPPLY CIRCUIT AND RADIO-FREQUENCY AMPLIFICATION CIRCUIT

BACKGROUND OF THE INVENTION

1. Field of the Invention

The present invention relates to a radio-frequency amplification circuit used for, for example, a transmitter and receiver of radio communication and a bias-voltage supply circuit used for it.

2. Description of the Related Art

With regard to a radio-frequency amplifier used for, for example, satellite communication, ground-based microwave communication, mobile communication and so on, in the case in which a radio-frequency amplification transistor is composed of an NPN bipolar transistor, a radio-frequency signal is applied to its base (input terminal), and a radio-frequency signal after amplification is outputted from its collector. On this occasion, for realizing high efficiency for a wide-range radio-frequency signal level, it is necessary to control the direct current bias voltage supplied to a base of a radio-frequency amplification transistor depending on an input signal level, and for that purpose, a bias-voltage supply circuit is connected to the base of the radio-frequency amplification transistor.

With regard to such a bias-voltage supply circuit, the method of controlling base current of the radio-frequency amplification transistor and deciding electric potential of the input terminal by setting a first NPN bipolar transistor composing a current mirror circuit with a radio-frequency amplification transistor and supplying a constant current to the first NPN bipolar transistor is general.

However, in this method, in the case in which input electric power of a radio-frequency signal increases, when base electric potential of the first NPN bipolar transistor composing the current mirror circuit with the radio-frequency amplification transistor fluctuates widely, rectification is generated by a PN junction (diode) between the base and the emitter of the transistor. That is, if the direct current level of the inputted radio-frequency signal fluctuates widely, when the electric potential is at a high level, this diode is powered on and direct current electric potential of the input signal descends. On the contrary, when the electric potential of the input signal is at a low level, since the diode is inverse-biased, electric potential descent does not arise. Since time-average is taken by this rectification, the electric potential of the input terminal of the radio-frequency signal descends with the increase of signal amplitude, and as a result, the electric power of a signal outputted from the radio-frequency amplifier is saturated and high power output cannot be obtained.

As a remedy, generally, there is known a technique of curbing the electric potential fluctuation of the input terminal of the radio-frequency signal by connecting a second NPN bipolar transistor for compensation between a base of a first NPN bipolar transistor mentioned later and a power supply voltage supply line, which compensates the fluctuation of the base electric potential of a first NPN bipolar transistor composing a current mirror circuit with a radio-frequency amplification transistor (for example, refer to Kokai (unexamined patent publication) No. H11(1999)-68473).

FIG. 7 is a circuit diagram including the composition of a bias circuit described in Kokai No. H11(1999)-68473.

In FIG. 7, a code 100 indicates a bias circuit and a code 200 indicates a radio-frequency amplifier. This bias circuit

100 has a function for compensating a base current of a transistor Q200 automatically in the case in which input electric power of the radio-frequency amplifier 200 increases.

In the radio-frequency amplifier 200 shown in FIG. 7, a code 201 indicates a radio-frequency input terminal, a code 202 indicates a radio-frequency output terminal and a code 203 indicates an electric power supply. Further, Q200 indicates a radio-frequency amplification transistor, C201 indicates a condenser connected between the radio-frequency 201 and the a base of the transistor Q200, C202 indicates a condenser connected between a collector of the transistor Q200 and the radio-frequency output terminal 202 and R203 indicates a resistor connected between a collector of the transistor Q200 and the electric power supply 203. Ibe expresses a base current of the transistor Q200 and Ice expresses a collector current of the transistor Q200.

In the bias circuit 100 shown in FIG. 7, a code 101 indicates an electric power supply and Q100 indicates a first NPN bipolar transistor composing the current mirror circuit with the radio-frequency amplification transistor Q200. Further, the transistor Q101 is a second NPN bipolar transistor for compensating base electric potential of the first bipolar transistor Q100.

Further, in the bias circuit 100 shown in FIG. 7, the transistors Q102 and Q103 are NPN bipolar transistors composing a current mirror circuit making the collector current of the second bipolar transistor Q101 a reference current and deciding collector current of the first NPN bipolar transistor Q100. Further, the resistor R100 is a reference resistor of the current mirror circuit with the transistors Q200 and Q100. Further, Iref is a reference current of the current mirror circuit with the transistor Q200 and Q100. Note that, the resistor R101 is a resistor supplying a bias to the base of the radio-frequency amplification transistor Q200 of the radio-frequency amplifier 200.

In the case in which the electric power of the radio-frequency signal inputted to the radio-frequency input terminal 201 increases, the base current Ibe of the radio-frequency amplification transistor Q200 increases and the collector current Ice of the radio-frequency amplification transistor Q200 increases. Simultaneously, the collector current of the second NPN bipolar transistor also increases, wherein this transistor compensates the base electric potential of the current mirror circuit composed of the radio-frequency amplification transistor Q200 and the first NPN bipolar transistor Q100. The transistors Q102 and Q103 operate as a current mirror circuit using a collector current of the second NPN bipolar transistor Q101 as a reference current. Therefore, in the case in which size ratio of the radio-frequency amplification transistor Q200 and the first NPN bipolar transistor Q100 is defined as N:1, N times current, that is, the current mirror ratio times of the reference current as a collector current of the first NPN bipolar transistor Q100 is applied to the collector of the first NPN bipolar transistor Q100. As a result, even if the base electric potential of the radio-frequency amplification transistor Q200 descends, the base current Ibe can be increased automatically so as to compensate the base current.

As described in Kokai (unexamined patent publication) No. H11(1999)-68473, in the composition of a bias circuit deciding the base current Ibe by a current flowing in the first NPN bipolar transistor Q100 composing the current mirror circuit with the radio-frequency amplification transistor Q200, descent by compensating the amount of descent of the base potential can be prevented and descent of gain produced by it can be prevented.

However, in this composition of related art, all that is achieved is that descent of the base potential is prevented and descent of gain is curbed in the high-power side by descent of the base potential, and what can be achieved is the improvement of the saturation characteristic of the radio-frequency amplification circuit further by shifting the point at which gain descends to the further high-power side.

SUMMARY OF THE INVENTION

An object of the present invention is to provide a radio-frequency amplification circuit having a saturation characteristic superior than the prior art, because descent of the electric potential of an input terminal of a radio-frequency signal does not occur because of the composition of the circuit, and an effect more than the curb effect of descent of the electric potential of the input terminal of the radio-frequency signal obtained by the prior art is obtained, and a bias-voltage supply circuit used for it.

A bias-voltage supply circuit according to the present invention is a bias-voltage supply circuit supplying a direct-current bias voltage to an input terminal of a radio-frequency amplification transistor amplifying a radio-frequency signal, having a constant-voltage power supply generating a constant voltage higher than the bias voltage, a rectifier transistor connected between a supply point of a bias voltage connected to an input terminal of the radio-frequency amplification transistor via an element for bias supply and a power supply voltage supply line, wherein a control terminal is kept by a constant voltage that the constant-voltage power source generates, and a constant-current power supply connected between the supply point of the bias voltage and a reference-voltage supply line to supply a constant current to the rectifier transistor.

In the present invention, it is preferable that a negative feedback transistor controlled by the electric potential of the supply point of the bias voltage and applying negative feedback to the rectifier transistor is connected between the control terminal of the rectifier transistor and a reference-voltage supply line.

Specifically, the constant-voltage power supply has two transistors diode-connected respectively and series-connected between a control terminal of the transistor for rectification and a reference-voltage supply line and a reference current power supply supplying a reference current path on a direct current connection of two transistors.

In this case, further specifically, the constant-voltage power supply is composed of a transistor connected with the transistor of a reference-voltage supply side in the two series-connected transistors via control terminals commonly and connected between the supply point of the bias voltage and a reference-voltage supply line.

A radio-frequency amplification circuit according to the present invention has a radio-frequency amplification transistor amplifying a radio-frequency signal and a bias-voltage supply circuit connected to an input terminal of the radio-frequency amplification transistor and supplying a direct current bias voltage to the input terminal, and the bias-voltage supply circuit has a constant-voltage power supply generating a constant voltage higher than the bias voltage, a rectifier transistor connected between a supply point of a bias voltage connected to an input terminal of the radio-frequency amplification transistor via an element for bias supply and a power-supply-voltage supply line, wherein a control terminal is kept by a constant voltage that the constant-voltage power source generates, and a constant-current power supply connected between the supply point of the bias voltage and a reference-voltage supply line to supply a constant current to the rectifier transistor.

According to a bias-current supply circuit having such a composition (and a radio-frequency amplification circuit including it), in the case in which the electric power of a radio-frequency signal supplied to an input terminal of a radio-frequency amplification transistor increases and its signal amplitude changes widely via an element for bias supply, the change of the signal amplitude changes the electric potential of a bias voltage supply point, that is, a terminal of the reference voltage side of a rectifier transistor. A gate of the rectifier transistor is kept by a voltage larger than a bias voltage generated by the constant-voltage power supply, and the rectifier transistor is controlled so that a constant current flows by a constant-current power supply. When the electric potential of the terminal of the reference voltage side (the bias voltage supply point) becomes higher, an applied voltage between this reference voltage terminal and a control terminal becomes smaller and the state of the rectifier transistor changes so as to turn off. On the contrary, when electric potential of the bias voltage supply point becomes lower, the applied voltage between the reference voltage terminal and the control terminal of the rectifier transistor becomes larger and the state thereof changes so as to turn on. Therefore, when the time-average of this high electric power signal is taken at the time of its inputting, the direct current level of the bias voltage rises in comparison with the time of inputting small electric power. Further, when the input electric power becomes higher, rise of this bias voltage reaches a certain limit and the bias voltage descends as a reflection of a saturation characteristic of the transistor. That is, in the present invention, an operation in which the bias voltage is raised once at the high electric power side is obtained.

According to a bias-voltage supply circuit and a radio-frequency amplification circuit using it, as mentioned above, an operation in which a bias voltage is raised once the high electric power side is obtained, as a result, an effect shifting the point at which the gain descends to a high electric power side can be obtained. As a result, by the present invention, a radio-frequency amplification circuit having superior linearity and a saturation characteristic with a high input electric power can be realized.

BRIEF DESCRIPTION OF THE DRAWINGS

These and other objects and features of the present invention will become clearer from the following description of the preferred embodiments given with reference to the accompanying drawings, in which.

DESCRIPTION OF THE PREFERRED EMBODIMENTS

Figure 1:
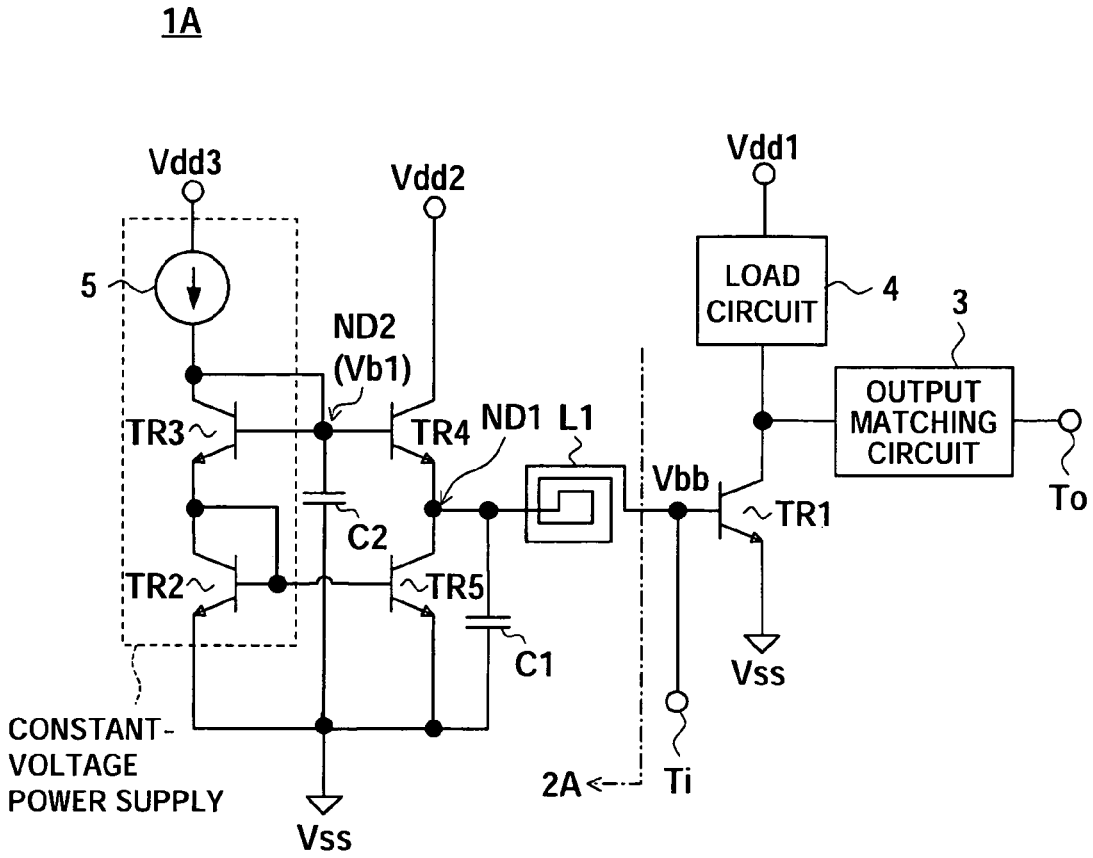
FIG. 1 is a circuit diagram of a radio-frequency amplification circuit in a first embodiment of the present invention.

Preferred embodiments of the present invention will be described with reference to the accompanying drawings in which the case of using a bipolar transistor as a transistor is defined as an example. Note that, in the present invention, it is possible to use a MOS transistor as a transistor; in that case, by displacing an NPN bipolar transistor with a MOS transistor in the drawings below and displacing "base" with "gate", "emitter" with "supply" and "collector" with "drain", it is possible to apply the present invention in a similar way.

First Embodiment

FIG. 1 is a circuit diagram of a radio-frequency amplification circuit in the present embodiment.

The use of electric power amplification of radio communication is usually composed of a multistage; however, in FIG. 1, only the last stage is shown for simplification of the diagram.

A radio-frequency amplification circuit 1A shown in FIG. 1 has an input terminal of a radio-frequency signal Ti, a radio-frequency amplification transistor TR1 composed of an NPN bipolar transistor whose base is connected with the input terminal Ti and a bias voltage supply circuit 2A controlling a direct-current voltage (hereinafter referred to as a bias voltage) of the base (the input terminal Ti) of this radio-frequency amplification transistor TR1. An output matching circuit 3 is connected between a collector of the radio-frequency amplification transistor TR1 and an output terminal To, and a load circuit 4 is connected between a collector of the radio-frequency amplification transistor TR1 and a electric supply voltage Vdd1.

In such a composition, a radio-frequency signal inputted from the input terminal Ti is outputted from the output terminal To after amplifying by the radio-frequency amplification transistor TR1 and impedance-matching.

A bias-voltage supply circuit 2A has four NPN bipolar transistors TR2, TR3, TR4 and TR5, two capacitors C1 and C2, a reference-electric-current supply 5 and an inductor L1.

An example of a "constant-voltage power supply" is composed of the transistors TR2 and TR3 and the reference-current power supply 5. Further, the transistor TR4 composes an example of a "rectifier transistor", and the transistor TR5 composes an example of a "constant-current power supply". Note that, in FIG. 1, a bias voltage is shown as a code Vbb. Since a connection midpoint of the transistors TR4 and TR5 is connected to the input terminal (base) of the radio-frequency amplification transistor TR1 via an inductor, this connection midpoint of the transistors TR4 and TR5 is a supply point ND1 (hereinafter referred to as a node ND1) of the bias voltage Vbb.

The reference-current power supply 5 and the transistors TR3 and TR2 composing the constant-voltage power supply are series-connected between the electric supply voltage Vdd and a reference voltage Vss. About the transistors TR2 and TR3, a base and a collector are connected respectively, that is, each transistor is diode-connected. A connection point of the base and the collector of the transistor TR3 (hereinafter referred to as a node ND2) is an output of this constant-voltage power supply, and the constant-voltage power supply has a function to keep the electric potential of this node ND2 constant in response to a current flowing through the reference-current power supply 5. Hereinafter, electric potential of the node ND2 is defined as Vb1.

A base of the rectifier transistor TR4 is connected to the node ND2. A collector of the rectifier transistor TR4 is connected to a supply line of an electric supply voltage Vdd2 and its emitter is connected to the node ND1 that is a supply point of the bias voltage Vbb. The capacitor C2 is connected between the base (node ND2) of the rectifier transistor TR4 and the reference voltage Vss, and as a result, oscillation of that rectifier transistor is prevented and stabilization of the electric potential of the node ND2 is achieved.

The transistor TR5 connected between the node ND1 and the reference voltage Vss has a function as a constant-current power supply for flowing a constant current through the rectifier transistor TR4; about that point, it may be replaced with a constant-current power supply circuit or a resistor having another composition and so on. Here, a base of the transistor TR5 is connected to a diode-connected base of the transistor TR2. Further, the capacitor C1 is connected between the node ND1 and the reference voltage Vss, and therefore the node ND1 is AC grounded.

Next, an operation of such a circuit composition will be explained.

Figure 7:
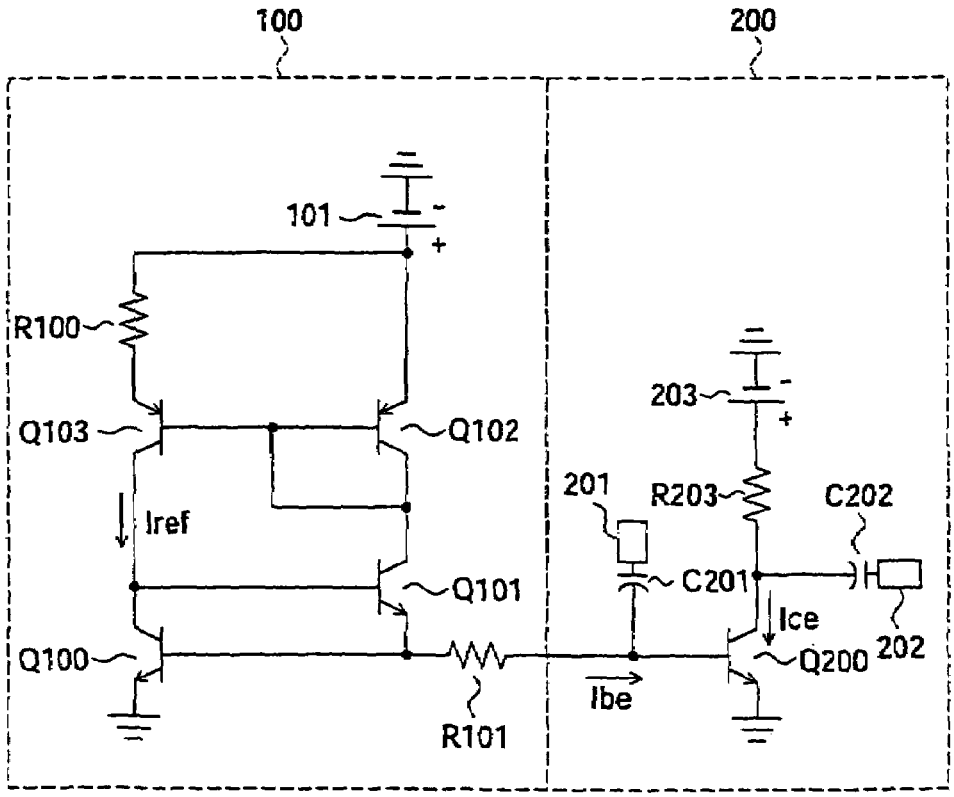
FIG. 7 PRIOR ART
FIG. 7 is a circuit diagram including composition of a bias circuit described in Kokai (unexamined patent publication) No. H11(1999)-68473.

In the bias voltage supply circuit 2A according to the present embodiment, a transistor composing a current mirror circuit with a radio-frequency amplification transistor (for example, Q100 in FIG. 7) is not set as well as a bias voltage supply circuit of the related art. Therefore, a main transistor controlling the electric potential of the bias voltage Vbb is the rectifier transistor TR4, and this transistor TR4 functions as a rectification element by which the amount of the current is controlled by the electric potential of an emitter.

Two diode-connected transistors TR2 and TR3 generate basic voltage Vb1 for giving the bias voltage Vbb of the base of the radio-frequency amplification transistor TR1 at the node ND2 via the rectifier transistor TR4. That is, when a base bias current of an NPN-bipolar-transistor level current is flowed by the reference-current power supply 5, electric potential Vb1 of the node ND2 becomes about twice the voltage of the bias voltage of the base Vbb when a radio-frequency signal is not inputted to the radio-frequency amplification transistor TR1. This electric potential Vb1 of the node ND2 can be fine-tuned by a current given from the reference-current power supply 5.

The rectifier transistor TR4 operates as a so-called common-collector-type amplifier, and the bias voltage Vbb descended by a voltage between the base and the emitter of the rectifier transistor is outputted to the radio-frequency amplification transistor TR1. At this time, the transistor TR5 operates as a constant-current power supply. The transistor TR5 draws a portion of the current outputted from the emitter of the rectifier transistor TR4 and flows it to the reference electric potential Vss.

The capacitor C1 is implemented for reducing a radio-frequency signal component that could not be blocked by the inductor L1. However, as mentioned later, if the radio-frequency signal component is removed off, the present invention cannot demonstrate the effect, and therefore it is necessary to implement elements having a value suitable as the capacitor C1 and the inductor L1. Note that, in the case in which the radio-frequency component suppression ability of the inductor L1 is enough, the capacitor C1 may be omitted. Further, the capacitor C2 for preventing oscillation can be omitted in the case in which the electric potential Vb1 of the node ND2 is in stable.

In the case in which there is no radio-frequency signal inputted from the input terminal Ti or the case in which an input voltage of a radio-frequency signal is low and its amplitude is comparatively small, since the current drive ability of the transistor TR5 as a constant-current power supply overcomes the electric potential fluctuation of the node ND1 and flows constant current to the rectifier transistor TR4, the bias voltage Vbb emerged at the node ND1 does not change.

When input electric power of a radio-frequency signal increases and its amplitude becomes comparatively large, a radio-frequency signal component attenuated by the inductor L1 and the capacitor C1 changes the electric potential of the node ND1. Therefore, electric potential of the emitter of the transistor TR4 and the collector of the transistor TR5 becomes large and small with time. Since the collector of the transistor TR5 has high impedance, that operation is hardly affected by this radio-frequency signal component.

On the contrary, the rectifier transistor TR4 changes its electric potential with the following behavior by a phase state of the radio-frequency signal applied to the emitter.

First, when an emitter voltage of the rectifier transistor TR4 swings positively widely, a voltage between the base and the emitter of the transistor TR4 becomes small, the transistor TR4 becomes an off state and a collector current is temporally interrupted.

Further, when an emitter voltage of the rectifier transistor TR4 swings negatively widely, a voltage between the base and the emitter of the transistor TR4 becomes large, the transistor changes to an on state deeply and a large current is flowed between the collector and the emitter.

Although these two states are repeated by the time change of the radio-frequency signal presented at the node ND1, and since a current flowing in the rectifier transistor TR4 becomes exponentially large for its voltage between the base and the emitter, a rectification operation is performed such that current larger than time of no signal as the time average. As a result, the DC level of the bias voltage Vbb supplied to the base of the radio-frequency amplification transistor TR1 increases by growing the input electric power and amplitude of the radio-frequency signal component.

Further, when electric power of an inputted radio-frequency signal is enlarged, the rise of this bias voltage Vbb reaches a pole by regulation by saturation characteristic of the bipolar transistor and so on, and after that, it changes to a decrease.

Figure 2:
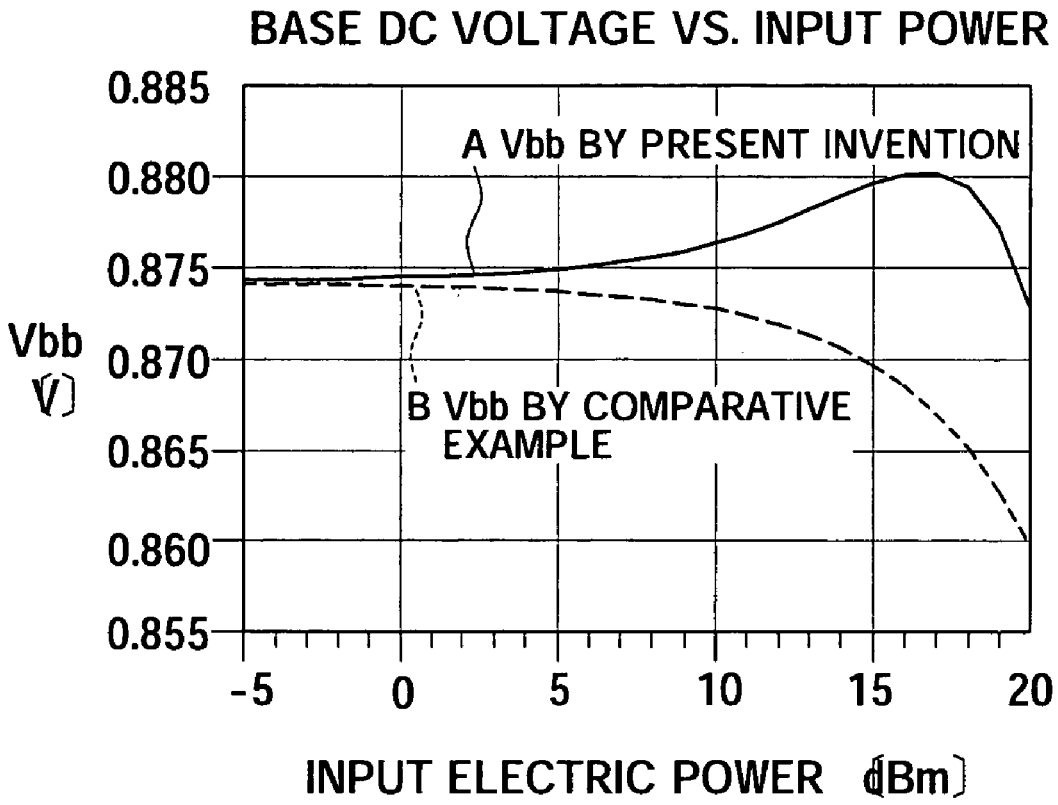
FIG. 2 is a graph showing a characteristic for input electric power of a bias voltage.

In FIG. 2 an electric power characteristic for input of this bias voltage Vbb is shown.

In FIG. 2 a curve A shows a characteristic in the case of using the bias voltage supply circuit 2A according to the present embodiment. It is understood that the curve A rises once as input electric power becomes large and descends when the pole is passed.

Figure 3:
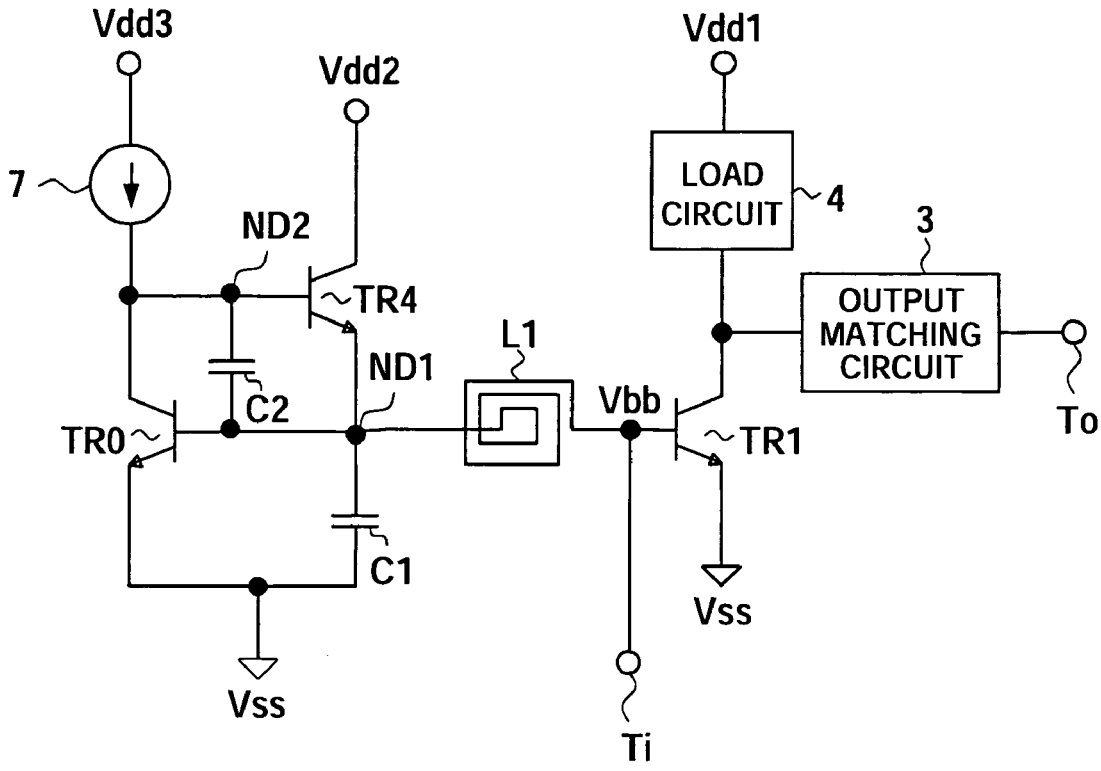
FIG. 3 is a circuit diagram showing the composition of a comparison example of the present invention.

On the contrary, as a comparative example, a characteristic in the case of setting a transistor composing a current mirror circuit with a radio-frequency amplification transistor is shown in FIG. 2 as a curve B. The composition of this comparative example is shown in FIG. 3. Note that, the composition in common with FIG. 1 is appended the same code in FIG. 3.

In a circuit of the comparative example shown in FIG. 3, an NPN bipolar transistor TR0 in which a gate is connected at the node ND1 and a reference-current power supply 7 are series-connected between an electric supply voltage Vdd3 and the reference voltage Vss. The NPN bipolar transistor TR0 composes a current mirror circuit with the radio-frequency amplification transistor TR1, and a base current of the radio-frequency amplification transistor TR1 is prescribed by a current of the reference-current power supply 7. In this case, since the node ND1 is connected to the base of the transistor TR0, a rectification of the transistor TR0 becomes apparent by a radio-frequency signal component leaked to the node ND1, it surpasses current compensation by the transistor TR4, and as a result, electric potential of the node ND1 decreases monotonically with an increase of input electric power (refer to the curve B in FIG. 2).

Second Embodiment

Figure 4:
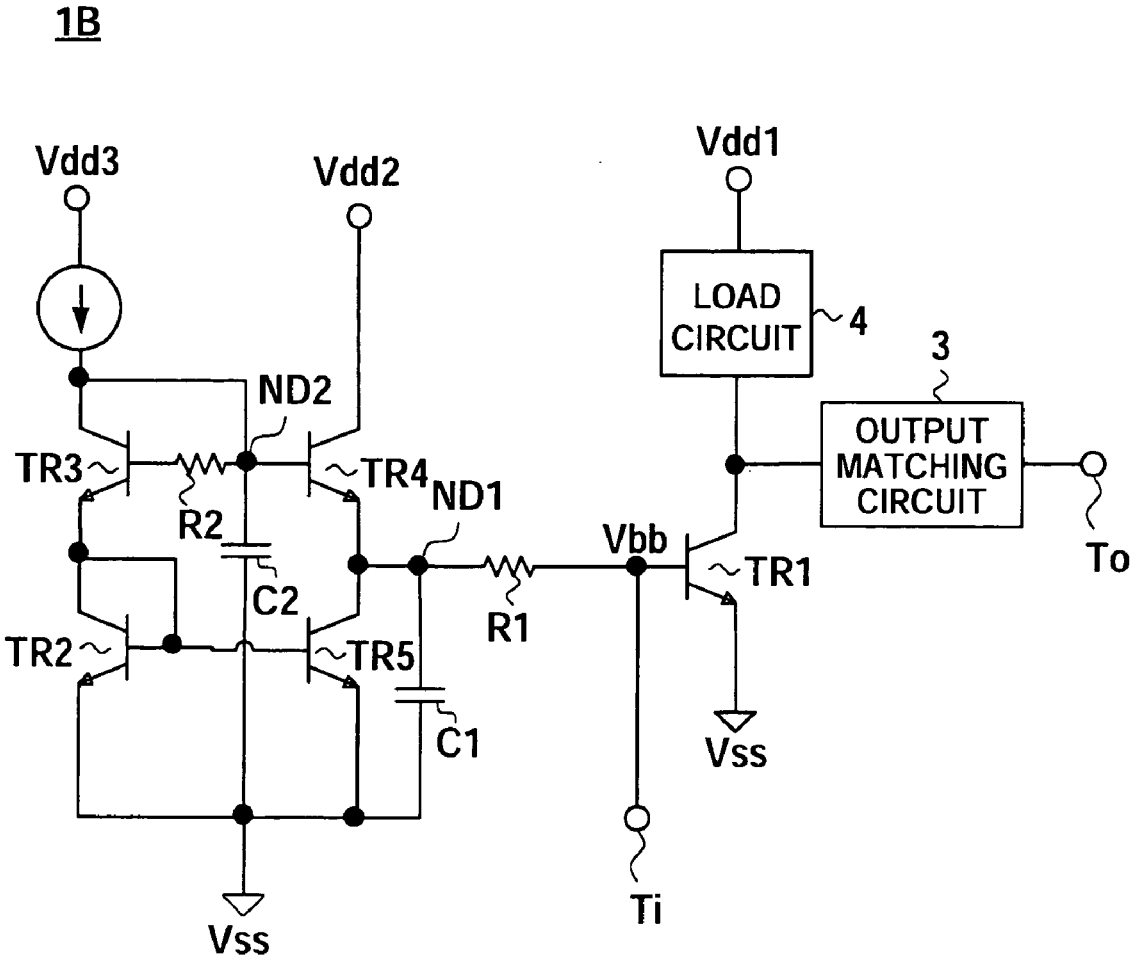
FIG. 4 is a circuit diagram of a radio-frequency amplification circuit according to a second embodiment of the present invention.

FIG. 4 is a circuit diagram of a radio-frequency amplification circuit according to a second embodiment.

The points by which a radio-frequency amplification circuit 1B shown in FIG. 4 are different from the composition shown in FIG. 1 are a point at which a resistor R1 is set in place of the inductor L1 as a bias supply element and a point at which a resistor R2 is set between the node ND2 and the gate of the transistor TR3. This resistor R2 may be set even in the composition of FIG. 1 if necessary for preventing oscillation. Here, a large change is a point at which the bias supply element is the resistor R1, even in the case in which the suppression ability of a radio-frequency component can be obtained as well as the inductor L1, an effect that the bias voltage Vbb is raised once with an increase of input electric power can be obtained by a large voltage fluctuation of the node ND1 by applying the present invention.

In the present embodiment, by replacing the inductor L1 with the resistor R1, an advantage obtained by the other point of view is that an area occupied by the bias supply element can be reduced.

Third Embodiment

Figure 5:
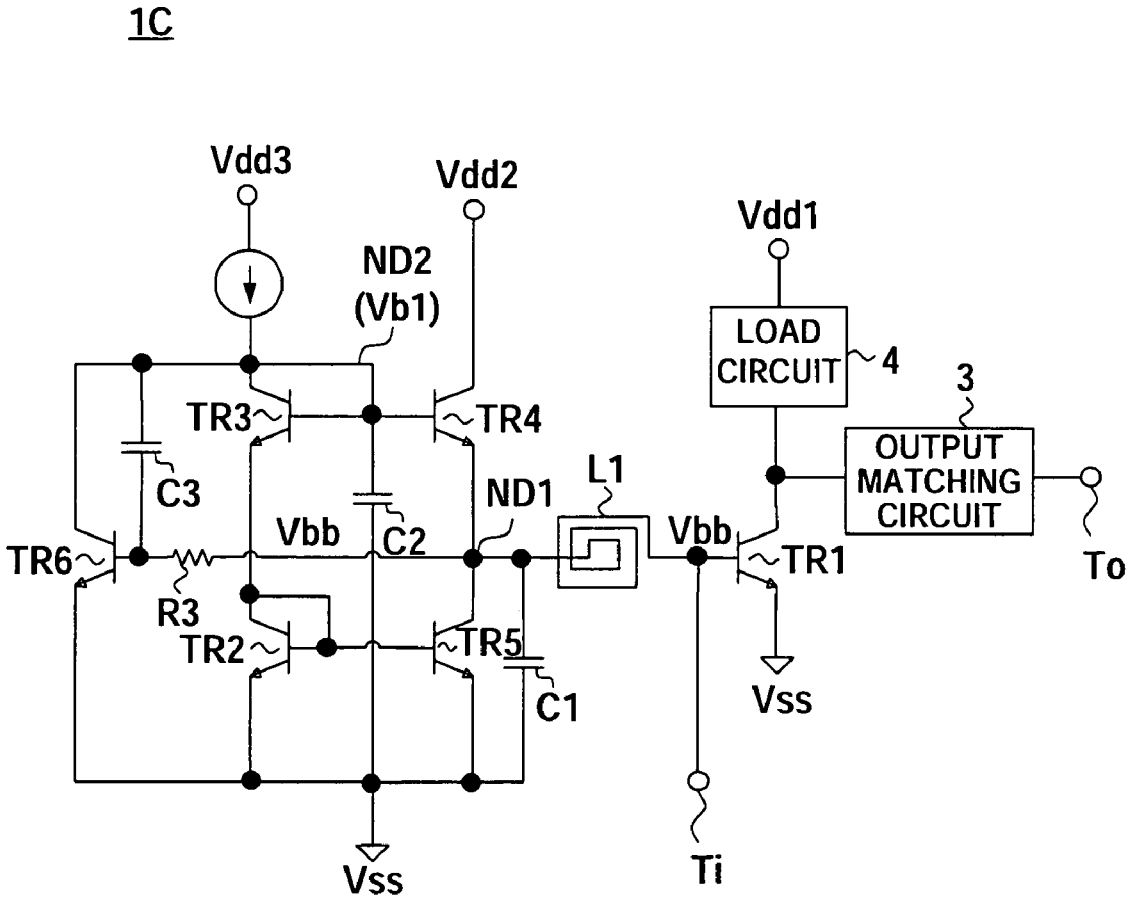
FIG. 5 is a circuit diagram of a radio-frequency amplification circuit according to a third embodiment of the present invention.

FIG. 5 is a circuit diagram of a radio-frequency amplification circuit according to a third embodiment.

A large point by which a radio-frequency amplification circuit 1C shown in FIG. 5 is different from the composition shown in FIG. 1 is that a negative feedback transistor TR6 applying negative feedback to the rectifier transistor TR4 is connected between the node ND2 and the reference voltage Vss. For stabilizing this negative feedback transistor TR6, a capacitor C3 and a resistor R3 are set as arbitrary composition. The capacitor C3 is connected between a collector and a base of the negative feedback transistor TR6, and the resistor R3 is connected between the base of the negative feedback transistor TR6 and the node ND1.

When the voltage Vbb of the node ND1 is raised, electric potential of the base terminal of the negative feedback transistor TR6 connected to the node ND1 via the resistor R3 is raised. Then, a current flowing between the collector and the emitter of the negative feedback transistor TR6 increases. At this time, a portion of a current from a reference current power supply that should flow to the two diode-connected transistors TR2 and Tr3 is drawn by the transistor TR6, so the electric potential Vb1 of the node ND1 descends. Therefore, applied voltage between the base and the emitter of the rectifier transistor TR4 descends for that and a point at which the bias voltage Vbb is reduced or raised is shifted.

That is, in the circuit composition shown in FIG. 1, in which the bias voltage Vbb is raised excessively with a rise of input electric power or the case of requiring a shift of a rising point to the lower input electric power side, by adding such a negative feedback transistor TR6, an advantage of satisfying such a requirement can be obtained.

Note that, the control of a degree of the rise of such a bias voltage Vbb and its rising point also can be performed by changing each of the element parameter values of the inductor L1 and the capacitor C1 and controlling the largeness of a radio-frequency signal component leaked to the node ND1. However, there is a limit on such a change of the element parameters, and disadvantages on the cost and so on might be large when changing the element parameters because of the area penalty and the restriction on the process. Particularly, when enlarging the inductor L1, not only the occupied area becomes large, but the characteristic obtained when enlarging the area might become a limit. Further, when enlarging the capacitor C1, the occupied area also becomes large; when adopting a capacitor whose occupied area is small, there is a disadvantage that the structure becomes complex and the process cost is raised.

In the present embodiment, for example, in the case where only control of the element parameters of the inductor L1 and the capacitor C1 is not enough like this, by compensating for that with an operation of the negative feedback transistor, the degree of freedom of the control of an electric characteristic for input electric power of the bias voltage Vbb becomes high. As a result, realization of a radio-frequency amplification circuit that obtains a desired characteristic more easily while suppressing the cost disadvantage can be realized.

Further, setting the negative feedback transistor TR6 contributes to the stabilization of the bias voltage for the fluctuation of the electric supply voltage.

In detail, since the radio-frequency amplification transistor TR1 has very high impedance ideally when the electric supply voltage Vdd1 fluctuates, a base current and a collector current do not change. However, practically, realization of such an ideal transistor is difficult because of restrictions of process and size and so on. Therefore, consideration of the fluctuation of the electric supply is required.

When by the fluctuation of the electric supply voltage the base current of the radio-frequency amplification transistor TR1 changes widely, the collector current of the transistor TR4 fluctuates and the voltage between the base and the emitter Vbe also changes. When the electric supply voltage is raised, the base current of the transistor TR1 becomes small, the current between the base and the emitter Ibe of the transistor TR6 becomes small, a state of the transistor TR6 turn to power-off and a current component drawn by the transistor TR6 decreases. Therefore, since the base electric potential Vb1 of the rectifier transistor TR4 is raised, the transistor TR4 becomes a state that turns to power-on more easily, and as a result, the bias voltage Vbb becomes large and operates to enlarge the base current of the transistor TR1. On the contrary, when the base current of the transistor TR1 becomes large by an electric power fluctuation, by tracing the above-mentioned opposite process, it operates to reduce the base current.

As mentioned above, in the present embodiment, the effect to control a bias voltage fluctuation by an electric supply voltage fluctuation can be obtained.

Next, in the above first to the third embodiments, the bias voltage Vbb is raised once; however, an effect that it gives to a gain characteristic will be explained.

Figure 6:
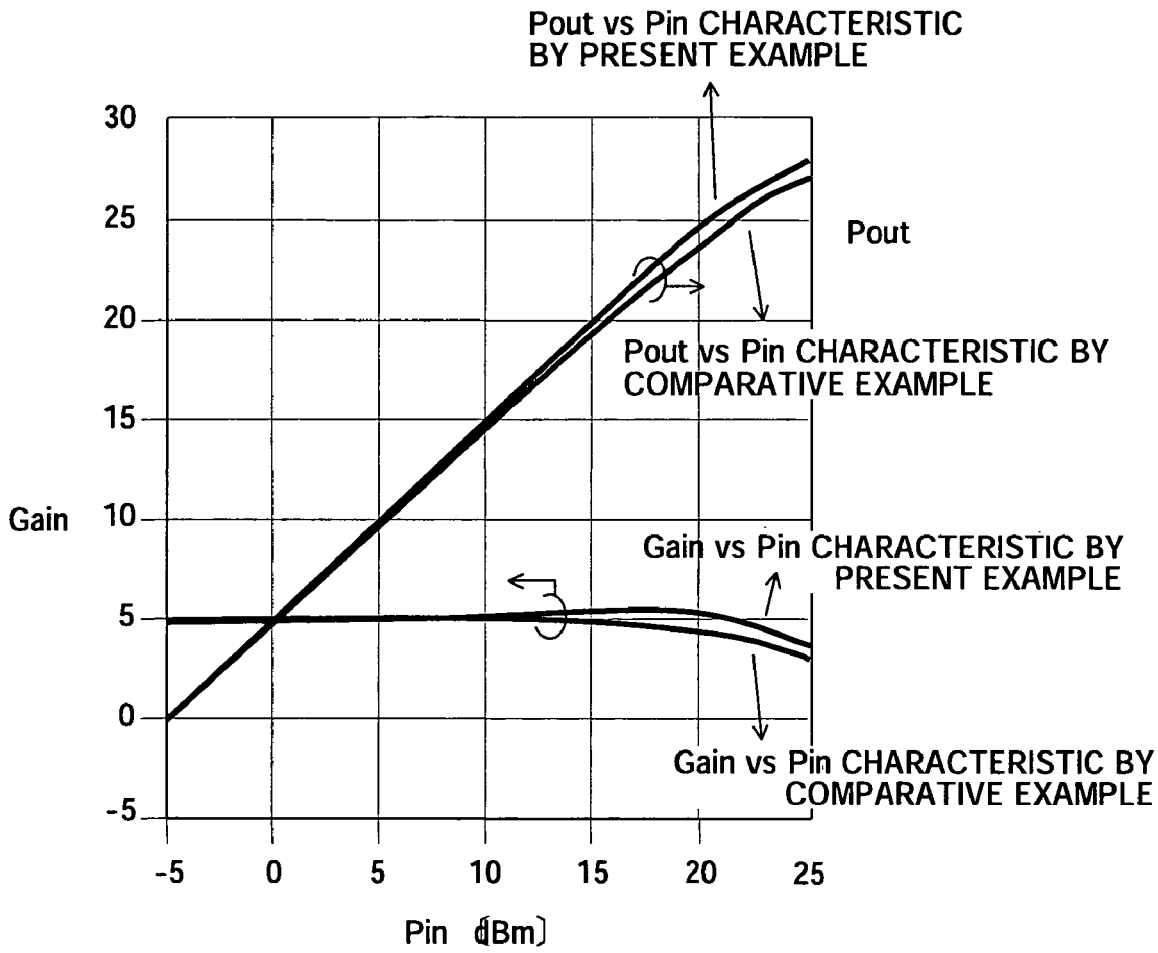
FIG. 6 is a graph plotting of electric power gain (Gain) and output electric power (Pout) for input electric power (Pin)

FIG. 6 is a characteristic diagram of an electric power gain (Gain) and electric power of an output radio-frequency signal (Pout) for electric power of an input radio-frequency signal (Pin). In FIG. 6, when changing the electric power of the input radio-frequency signal (Pin) in each of a circuit of the first embodiment of the present invention shown in FIG. 1 and a circuit of a comparative example shown in FIG. 3, changes of the electric power of the output radio-frequency signal (Pout) and the electric power gain of the radio-frequency amplifier (Gain) are shown by four curves.

The quality of a saturation characteristic of electric power is decided by whether a linear region is wide and whether a point at which saturation begins corresponds to high input electric power. Although there are many methods of judging this quality of the characteristic, for a radio-frequency electric-power amplifier generally, the quality of the electric saturation characteristic is judged by measuring a so-called P1 dB (1 dB gain compression power-point). The P1 dB is defined as the input (or output) electric power when the gain descends by 1 dB from the linear region in raising the input electric power.

As shown in FIG. 6, it is understood that, in the case of the present embodiment, compared with the case of the comparative example, the linear region is wide and an electric power saturation point is shifted to the high electric power side. For showing this quality of the characteristic quantitatively, when comparing the P1 dB, the P1 dB of the case of the present embodiment is higher by about 0.8 dBm than the P1 dB of the case of the comparative example. Further, even if raising the bias voltage Vbb in the present embodiment, the gain characteristic is obtained with an approximately flat characteristic until high input electric power at which the gain begins to descend in a way similar to the compared example.

Note that, in a judgment of the quality of electric power saturation, the same result can be obtained by methods other than the above-mentioned method comparing the P1 dB.

As mentioned above, it is proved that with a bias electric power supply circuit of the present invention, the P1 dB of a radio-frequency electric power circuit is improved and linearity of an electric-power saturation characteristic is improved.

Note that the present invention is not limited to the above embodiments and includes modifications within the scope of the claims.

What is claimed is:

1. A bias voltage supply circuit supplying a direct current bias voltage to an input terminal of a radio-frequency amplification transistor amplifying a radio-frequency signal, comprising:

a constant-voltage power supply generating a constant voltage higher than said bias voltage;

a rectifier transistor connected between a supply point of said bias voltage connected to said input terminal of said radio-frequency amplification transistor via an inductor (L) which reduces a high frequency component, and a power supply voltage supply line, wherein a control terminal is kept at a constant voltage generated by a constant-voltage power supply; and a constant-current power supply connected between said supply point of the bias voltage and a reference voltage supply line to supply a constant current to said rectifier transistor;

wherein a negative feedback transistor; controlled by electric potential of said supply point of the bias voltage and applying negative feedback to said rectifier transistor; is connected between said control terminal of the rectifier transistor and said reference voltage supply line.

2. The bias voltage supply circuit as set forth in claim 1, wherein a capacitor is connected between said supply point of the bias voltage and said reference voltage supply line and said supply point of the bias voltage is AC grounded.

3. The bias voltage supply circuit as set forth in claim 1, wherein a capacitor is connected between said control terminal of the rectifier transistor and said reference voltage supply line and said control terminal of the rectifier transistor is AC grounded.

4. The bias voltage supply circuit as set forth in claim 1, wherein a capacitor is connected between said supply point of the bias voltage and said reference voltage supply line.

5. The bias voltage supply circuit as set forth in claim 1, wherein a capacitor is connected between said control terminal of the rectifier transistor and said reference voltage supply line.

6. The bias voltage supply circuit as set forth in claim 1, wherein said constant-voltage power supply comprises:

two transistors diode-connected respectively and series-connected between said control terminal of the rectifier transistor and said reference voltage supply line; and a reference current power supply supplying a reference current to a series-connection path of said two transistors.

7. The bias voltage supply circuit as set forth in claim 6, wherein said constant-current power supply comprises a transistor connected with the transistor of said reference voltage supply side in said two series-connected transistors via control terminals commonly and connected between said supply point of the bias voltage and said reference voltage supply line.

8. A bias voltage supply circuit supplying a direct current bias voltage to an input terminal of a radio-frequency amplification transistor amplifying a radio-frequency signal, comprising:

a constant-voltage power supply generating a constant voltage higher than said bias voltage;

a rectifier transistor connected between a supply point of said bias voltage connected to said input terminal of said radio-frequency amplification transistor via an element for bias supply, and a power supply voltage supply line, wherein a control terminal is kept at said constant voltage generated by said constant-voltage power supply; and a constant-current power supply connected between said supply point of the bias voltage and a reference voltage supply line to supply a constant current to said rectifier transistor, wherein a negative feedback transistor; controlled by electric potential of said supply point of the bias voltage and applying negative feedback to said rectifier transistor; is connected between said control terminal of the rectifier transistor and said reference voltage supply line.

9. The bias voltage supply circuit as set forth in claim 8, wherein a capacitor is connected between said supply point of the bias voltage and said reference voltage supply line and said supply point of the bias voltage is AC grounded.

10. The bias voltage supply circuit as set forth in claim 8, wherein a capacitor is connected between said control terminal of the rectifier transistor and said reference voltage supply line and said control terminal of the rectifier transistor is AC grounded.

11. The bias voltage supply circuit as set forth in claim 8, wherein a capacitor is connected between said supply point of the bias voltage and said reference voltage supply line.

12. The bias voltage supply circuit as set forth in claim 8, wherein a capacitor is connected between said control terminal of the rectifier transistor and said reference voltage supply line.

13. The bias voltage supply circuit as set forth in claim 8, wherein said constant-voltage power supply comprises:

two transistors diode-connected respectively and series-connected between said control terminal of the rectifier transistor and said reference voltage supply line; and a reference current power supply supplying a reference current to a series-connection path of said two transistors.

* * * * *

UNITED STATES PATENT AND TRADEMARK OFFICE

CERTIFICATE OF CORRECTION

PATENT NO. : 7,259,615 B2
APPLICATION NO. : 11/047564
DATED : August 21, 2007
INVENTOR(S) : Noboru Sasho et al.

It is certified that error appears in the above-identified patent and that said Letters Patent is hereby corrected as shown below:

Column 10, Line 58:
"transistor;" should be corrected to -- transistor, --.

Column 10, Line 61:
"transistor;" should be corrected to -- transistor, --.

Column 12, Line 6:
"transistor;" should be corrected to -- transistor, --.

Column 12, Line 9:
"transistor;" should be corrected to -- transistor, --.

Signed and Sealed this

Sixth Day of November, 2007

JON W. DUDAS
*Director of the United States Patent and Trademark Office*